US007441356B2

(12) United States Patent
Schwartz

(10) Patent No.: US 7,441,356 B2
(45) Date of Patent: Oct. 28, 2008

(54) I-BEAM HINGE APPARATUS FOR DISPLAYING PROCEDURAL INFORMATION CARDS IN THE WORKPLACE

(75) Inventor: Russell J. Schwartz, Sausalito, CA (US)

(73) Assignee: Axzo Press L.L.C., San Francisco, CA (US)

( * ) Notice: Subject to any disclaimer, the term of this patent is extended or adjusted under 35 U.S.C. 154(b) by 303 days.

(21) Appl. No.: 11/042,484

(22) Filed: Jan. 24, 2005

(65) Prior Publication Data

US 2005/0160643 A1 Jul. 28, 2005

Related U.S. Application Data

(60) Provisional application No. 60/538,546, filed on Jan. 22, 2004, provisional application No. 60/579,503, filed on Jun. 10, 2004.

(51) Int. Cl.
*B42F 17/00* (2006.01)

(52) U.S. Cl. ..... 40/388; 40/341; 40/380; 40/661.09

(58) Field of Classification Search ..... 235/486; 402/45, 60; 434/118; 40/388, 390, 371, 40/341; 248/918; 281/45, 27.1; 361/681–683
See application file for complete search history.

(56) References Cited

U.S. PATENT DOCUMENTS 2,915,841 A * 12/1959 Van Dyke ..... 402/60
5,387,010 A * 2/1995 Mohr ..... 281/43
5,709,549 A * 1/1998 Jonson et al. ..... 434/118
5,819,456 A * 10/1998 Schwartz ..... 40/642.01
6,430,856 B1 * 8/2002 Schwartz ..... 40/642.01
6,533,236 B1 * 3/2003 MacLellan et al. ..... 248/442.2
7,124,954 B2 * 10/2006 Schwartz ..... 235/486

* cited by examiner

*Primary Examiner*—Lesley D. Morris
*Assistant Examiner*—Christopher E Veraa
(74) *Attorney, Agent, or Firm*—Davis Bujold & Daniels, P.L.L.C.

(57) ABSTRACT

An apparatus for displaying procedural information cards on a computer video monitor includes a central shaft having an upper end and a lower end, the upper end capped by an upper cross member having an upper planar arm extending in one direction from the shaft, and an upper arcuate arm extending the opposite direction. The lower end is terminated by a lower cross member having a lower planar arm and a lower arcuate arm. The apparatus includes means for affixing the apparatus to a surface on a computer video monitor. The arcuate arms of the apparatus extend outwardly from the monitor to facilitate installation and flipping of the cards. Each of the arcuate arms comprises a generally semi-circular ring, and means for preventing inadvertent removal of the cards from the arcuate arms.

4 Claims, 3 Drawing Sheets

I-BEAM HINGE APPARATUS FOR DISPLAYING PROCEDURAL INFORMATION CARDS IN THE WORKPLACE

CROSS REFERENCE TO RELATED APPLICATIONS

The present application claims the benefit of the filing date of U.S. Provisional Patent Application Ser. No. 60/538,546, filed Jan. 22, 2004, for an I-BEAM HINGE FOR DISPLAYING TECHNICAL INSTRUCTION CARDS ON A COMPUTER VIDEO MONITOR, and U.S. Provisional Patent Application Ser. No. 60/579,503, filed Jun. 10, 2004, for a HINGE AND BINDING APPARATUS FOR DISPLAYING PROCEDURAL INFORMATION CARDS IN THE WORKPLACE, both by applicant herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to information display devices, and more particularly to an apparatus for displaying procedural information cards on a computer video monitor or other piece of equipment, in a cashiering area or other workplace space.

BACKGROUND INFORMATION AND DISCUSSION OF RELATED ART

Office workers, retail associates and other personnel routinely place instructional information in the immediate vicinity of their workstation. Commonly, such material includes personalized employer or manufacturer provided instructions regarding software use, policy, procedures, or other information. For the purposes of this disclosure, such material will be generally termed procedural information.

The prior art includes numerous devices for attaching items to a computer display device. However, until the present inventor disclosed an inventive mounting apparatus in U.S. Pat. No. 5,819,456, hereby incorporated by reference herein, there remained a need for an apparatus that enables a computer user to position a maximum amount of utilitarian and decorative items in his or her field of view near the display screen. The '456 patent teaches a display card mounting device for attaching an instructional card holder directly to a front bezel surface of a computer display. The apparatus can be used in connection with attachable/detachable cards, for training personnel to use computers. The display cards may include tips and hints for using popular word processing programs, spread sheets, proprietary software programs, or other information pertaining to products and services. The display cards may include printed indicia showing, for example, a summary of useful software commands such as "short-cut" control sequences for triggering commands or scripts for customer service representatives.

Typically, the cards and the mounting apparatuses are employed as training aids to assist personnel or students in learning new material. Without the benefit of the system of the '456 patent, companies often trained personnel, and schools trained students exclusively by providing user manuals and requiring the personnel or students being trained to learn the software commands by directly consulting the user manuals. Such user manuals are expensive and need frequent replacement with each software upgrade. For proprietary software, such upgrades may be frequent and such user manuals may be quite expensive, resulting in significant costs. Also, when personnel are required to learn by consulting user manuals, the time required to effectively train the personnel may also be significant. In particular, the personnel may be reluctant to frequently consult a potentially cumbersome user manual which often is not easily accessible, and therefore may not learn the necessary new material quickly or efficiently. Hence, human trainers are often employed to expedite training, resulting in still further costs.

With the system of the '456 patent, display cards containing, for example, a summary of pertinent software commands, are provided for mounting directly to the computer display. To learn the pertinent procedures, personnel being trained merely consult the display cards. Depending upon the information provided on the display cards, it may be completely unnecessary to provide a separate user manual. Hence, the costs associated with providing new user manuals or providing supplements or inserts to existing user manuals are substantially avoided. Rather, only the costs associated with providing the relatively inexpensive display cards and the mounting apparatuses of the invention may be incurred. Such is particularly desirable when training personnel to use proprietary software subject to frequent upgrades which would otherwise require obtaining frequent, and possibly expensive, user manual updates. Moreover, by eliminating the need to consult cumbersome user manuals, personnel being trained may be trained much more quickly and efficiently, further reducing training costs. In many circumstances trainers may no longer be required.

With the system shown in the '456 patent, the display cards are mounted parallel with the display screen of the computer such that personnel being trained can easily reference information by simply glancing at the display cards. Hence, the speed by which new information provided on the cards can be consulted is greatly increased. Also, personnel being trained are simply more likely to consult reference information when such reference information is provided immediately adjacent to, and parallel with, the computer display, than when provided separately. Hence, training time can be significantly reduced.

Depending upon the amount of information required to be summarized, several display cards may be provided to personnel or students. With the system of the '456 patent, the display cards are tabbed and pivotally mounted such that personnel or students being trained can easily flip to the card containing the desired information. Also, the display cards are mounted to the display screen of the computer using semi-ring card holding members such that the cards can be quickly replaced with new cards to accommodate changes, or to add cards for new procedures. Cards may be replaced selectively either individually or several at a time, and this results in substantial savings if and as card content changes.

Although the display card system described in the '456 patent represented a significant improvement over predecessor systems, room for improvement remained, and the present inventor taught and disclosed such improvements in U.S. Pat. Nos. 6,209,246 and 6,430,856, each of which were progeny of the originally filed disclosure for the '456 patent, and each of which are incorporated in their entirety by reference herein.

U.S. Pat. No. 6,209,246 discloses a card assembly for use with a computer display device which includes at least one card and a card holder for holding the card. In addition, the card assembly also includes a mounting unit that is connected to the card holder. This mounting unit rigidly and detachably affixes the card holder to the computer display device.

U.S. Pat. No. 6,430,856 teaches a card assembly with a pocket for use with a computer display device. A variety of mounting systems are provided for mounting display cards, photographs, or other material to a computer display device of a computer system. The display cards may include printed indicia showing, for example, a summary of useful software commands for use with software programs running on the computer system. In one embodiment, a pair of mounting units or hinges are provided for pivotably mounting the display cards to the computer display device so that selected cards may be pivoted into a position adjacent to a front surface of the display screen for ease of viewing. In another example, a transparent pocket is provided for receiving the display cards, with the pocket being pivotably mounted to the display device via the mounting units. By providing a pocket, the display cards are protected while in use. Also, the display cards need not include any mounting holes or other attachment elements for direct attachment to the mounting units. Rather, any suitably sized and shaped display card, photograph, sheet of paper, or the like may be inserted within the pocket for pivotal mounting to the computer display device via the mounting hinges.

As with the more recently issued '246 and '856 patents, the present invention is also directed to providing further improvements in the art.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The invention provides a new and improved apparatus for displaying procedural information cards (hereinafter also referred to as flip cards) on a computer video monitor. The apparatus includes a central shaft having an upper end and a lower end, the upper end capped by an upper cross member having an upper planar arm extending in one direction from the shaft, and an upper arcuate arm extending the opposite direction. The lower end is terminated by a lower cross member having a lower planar arm and a lower arcuate arm, essentially mirroring the upper end elements. The apparatus includes means for affixing the apparatus to a surface on a computer video monitor, e.g., the terminal portions of the upper and lower planar arms may include adhesive, hook and loop fastener material, or other form of attachment. The arcuate arms of the apparatus extend outwardly from the monitor with no structure at its immediate rear to facilitate installation and flipping of procedural information cards. Each of the arcuate arms comprises a generally semi-circular ring, and may terminate by angling outwardly in a planar portion and extending in a plane generally opposite the respective planar arm. The planar portion includes a removable stop permitting addition and removal of flip cards, and for preventing inadvertent removal of flip cards from the arcuate arms.

It is therefore an object of the present invention to provide a new and improved apparatus for displaying procedural information cards in the workplace environment.

It is another object of the present invention to provide a new and improved apparatus for adding and removing such cards.

A further object or feature of the present invention is a new and improved apparatus for flipping the cards so displayed.

An even further object of the present invention is to provide a novel apparatus for positioning the cards relative to a computer monitor or other piece of equipment.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and its objects and advantages will become apparent when consideration is given to the following detailed description thereof. Such description makes reference to the annexed drawings wherein.

DETAILED DESCRIPTION OF THE INVENTION

Figure 1:
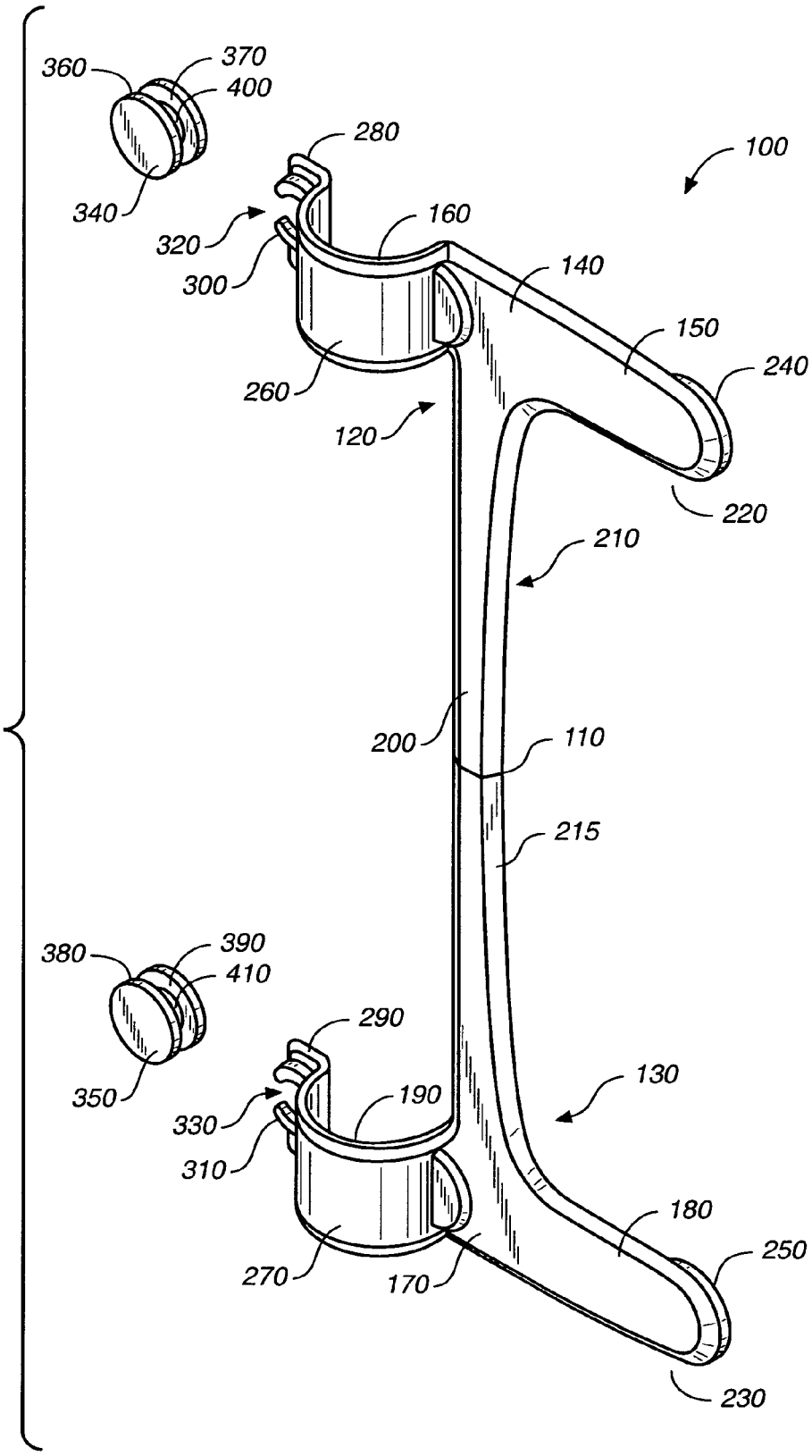
FIG. 1 is a perspective view of the apparatus for displaying procedural information on a computer video monitor of the present invention.
Figure 2:
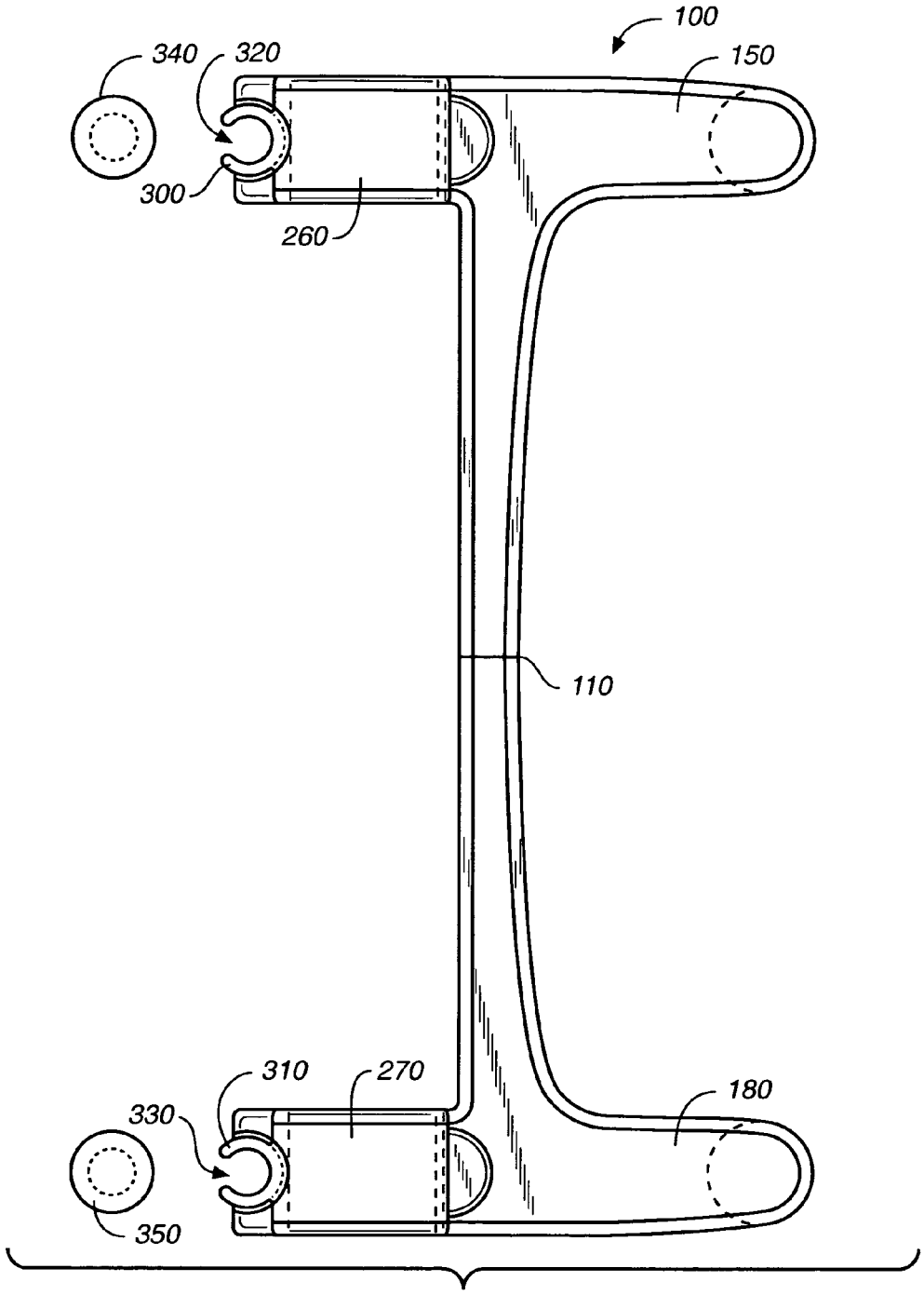
FIG. 2 is a front view in elevation thereof.
Figure 3:
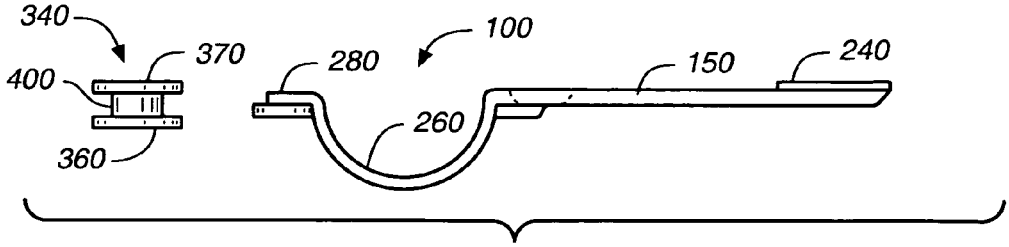
FIG. 3 is a top view thereof.
Figure 4:
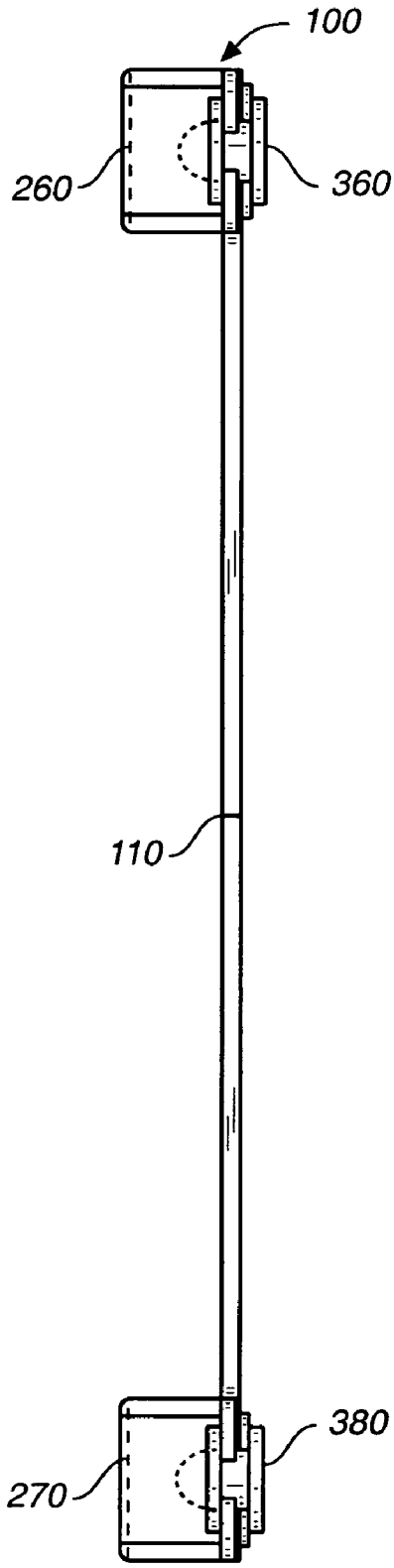
FIG. 4 is a side view in elevation thereof.

Referring to FIGS. 1 through 4, wherein like reference numerals refer to like components in the various views, there is illustrated therein a new and improved apparatus for displaying procedural information cards (hereinafter also referred to as flip cards) on a computer video monitor, generally denominated 100 herein. The figures illustrates a first preferred embodiment of the present invention, which, when viewed from the front (see FIG. 2) generally resembles an I-beam. Accordingly, the invention bears the proprietary name of the FLIPCARD I-BEAM. The apparatus may be summarily characterized as a flip card hinge, and it comprises a central shaft portion 110 having an upper end 120 and a lower end 130, the upper end capped by an upper cross member 140 having an upper planar arm 150 extending in one direction from the shaft portion, and an upper arcuate arm 160 extending the opposite direction from the shaft portion. The lower end is terminated by lower cross member 170 having a lower planar arm 180 also extending in one direction from the shaft portion and a lower arcuate arm 190 extending the opposite direction from the shaft portion, thus essentially mirroring the upper end elements. All of the foregoing elements include a front side 200 and a back side 210. In a preferred embodiment, a beveled edge 215 surrounds the entire apparatus.

The terminal portions 220, 230 of the upper and lower planar arms, respectively, include attachment means 240, 250, for affixing the apparatus to the side of the front chassis or front peripheral surface surrounding a CRT or LCD computer video monitor. Preferably the attachment means comprises double-sided adhesive material or hook-and-loop fastener, though any suitable affixation means is contemplated in the present disclosure. Alternatively, the attachment means may be carried on the central shaft or other portion of the apparatus. Accordingly, when affixed to one side of a monitor, the arcuate arms of the apparatus extend outwardly from the monitor with no structure at its immediate rear. This facilitates easy installation and flipping of instructional cards of the type shown in FIG. 10 of U.S. Pat. No. 6,430,856.

Each of the arcuate arms comprises a generally semi-circular ring, 260, 270, preferably terminating by angling outwardly in a planar portion 280, 290 and extending in a plane generally opposite the respective planar arm 150, 180. The arcuate arms includes means for preventing inadvertent removal of flip cards from the arcuate arms, such as a removable stop member on the planar portions in the form of an annular jaw 300, 310, each having openings 320, 330, such that the jaw is adapted to accept and capture a retaining button 340, 350. Each retaining button comprises spaced apart front and back discs 360, 370, 380, 390, separated by a hub 400, 410. When installed, jaws 300 and 310 clamp around the retaining button hub to hold the button and thereby to prevent the flip cards from being removed from the hinge. Conversely, removal of the retaining button permits addition and removal of one or more flip cards as desired.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An apparatus for displaying procedural information cards, said apparatus comprising:

a central shaft portion having an upper end and a lower end, said upper end including an upper cross member having an upper planar arm extending in a first direction from said central shaft portion, and an upper arcuate arm extending in the opposite direction, said lower end terminated by a lower cross member having a lower planar arm extending in said first direction from said central shaft portion and a lower arcuate arm extending in said opposite direction;

attachment means for affixing said apparatus to a surface on a computer video monitor;

each of said arcuate arms comprising a generally semi-circular ring; and stop means for preventing inadvertent removal of flip cards from said arcuate arms wherein said stop means comprises a removable stop member.

2. An apparatus for displaying procedure information cards, said apparatus comprising:

a central shaft portion having an upper end and a lower end, said upper end including an upper cross member having an upper planar arm extending in a first direction from said central shaft portion, and an upper arcuate arm extending in the opposite direction, said lower end terminated by a lower cross member having a lower planar arm extending in said first direction from said central shaft portion and a lower arcuate arm extending in said opposite direction;

attachment means for affixing said apparatus to a surface on a computer video monitor;

each of said arcuate arms comprising a generally semi-circular ring; and stop means for preventing inadvertent removal of flip cards from said arcuate arms wherein each of said arcuate arms terminates by analina outwardly in a planar portion including an annular jaw.

3. The apparatus for displaying procedural information cards of claim 2 wherein said stop means comprises a retaining button releasably captured by said annular jaw.

4. The apparatus for displaying procedural information cards of claim 3 wherein said retaining button comprises spaced apart front and back discs separated by a hub.

* * * * *